US006161699A

United States Patent [19]

Gartland

[11] Patent Number: 6,161,699

[45] Date of Patent: Dec. 19, 2000

[54] CHILD-RESISTANT BLISTER PACKAGE

[75] Inventor: Candace J. Gartland, Dover, Del.

[73] Assignee: ProClinical, Inc., Phoenixville, Pa.

[21] Appl. No.: 09/430,033

[22] Filed: Oct. 29, 1999

[51] Int. Cl.[7] ..... B65D 83/04; B65D 73/00

[52] U.S. Cl. ..... 206/531; 206/532; 206/534; 206/539

[58] Field of Search ..... 206/531, 532, 206/538, 539, 469, 534

[56] References Cited

U.S. PATENT DOCUMENTS

| | | | |
|---|---|---|---|
| 3,610,410 | 10/1971 | Seeley | 206/532 X |
| 3,899,080 | 8/1975 | Brunda | 206/531 |
| 3,924,746 | 12/1975 | Haines | 206/532 X |
| 4,011,949 | 3/1977 | Braber et al. | 206/532 |
| 4,125,190 | 11/1978 | Davie, Jr. et al. | 206/532 |
| 4,506,789 | 3/1985 | Dlugosz | 206/532 |
| 5,172,812 | 12/1992 | Wharton et al. | 206/531 |
| 5,310,060 | 5/1994 | Bitner et al. | 206/532 |
| 5,323,907 | 6/1994 | Kalvelage | 206/531 |
| 5,437,371 | 8/1995 | Lataix | 206/539 |
| 5,486,390 | 1/1996 | Burns et al. | 206/469 X |
| 5,529,188 | 6/1996 | Coggswell | 206/531 |
| 5,758,774 | 6/1998 | Leblong | 206/531 |
| 5,775,505 | 7/1998 | Vasquez et al. | 206/538 |
| 5,785,180 | 7/1998 | Dressel et al. | 206/532 |
| 5,878,887 | 3/1999 | Parker et al. | 206/531 X |
| 5,915,559 | 6/1999 | Hulick et al. | 206/538 X |
| 5,927,500 | 7/1999 | Godfrey et al. | 206/531 |
| 6,006,913 | 12/1999 | Ludemann et al. | 206/531 |

*Primary Examiner*—Bryon P. Gehman
*Attorney, Agent, or Firm*—William L. Feeney; Miles & Stockbridge PC

[57] ABSTRACT

An improved child resistant blister package for medicaments in pill form includes a blister sheet having a pattern of blisters formed therein for receiving individual pills and a rupturable lidding foil laminated to the blister sheet covering and sealing the blisters. A reinforcing card having a corresponding pattern of punch-outs formed therein by weakened score lines is laminated to the lidding foil with a punch-out overlying each blister, and a reinforcing film of high strength flexible material is laminated to the card using a low peel adhesive. The reinforcing film covers the punch-outs and an area of the card surrounding each punch-out, and has weakening score lines formed therein separating the areas overlying each punch-out to enable the reinforcing film to be peeled from the portion of the package overlying the individual punch-outs without disturbing the portion overlying the remaining punch-outs. The adhesive bond between the reinforcing film and the punch-out removes the punch-out upon peeling away of the overlying reinforcing film.

8 Claims, 2 Drawing Sheets

CHILD-RESISTANT BLISTER PACKAGE

BACKGROUND OF THE INVENTION

1. Field of the Invention

This invention relates to blister packaging of products such as medication in pill, tablet, capsule or lozenge form, and more particularly to an improved, child resistant blister package for such products.

2. Description of the Prior Art

It is common practice to use blister packages to package small solid articles or products which may be dispensed from the package by applying pressure to the blister to force the article or product from an individual blister or capsule through a rupturable foil. Since such packaging is widely used in the marketing of medicaments in pill, tablet, capsule or lozenge form (hereinafter, pills) the invention will be referred to herein with respect to package particularly suitable for such use, it being understood that the package maybe used for other products as well.

Blister packages of the type employed for packaging medication in pill form typically comprise a first sheet of transparent or translucent thermoformable material such as polyvinyl chloride or polystyrene having a plurality of flexible bubbles or blisters preformed therein and projecting outwardly from one surface to define separate compartments for individual doses of medicine, typically a single pill, and a second lidding or cover sheet of rupturable material such as aluminum foil or paper bonded to the first sheet and overlying and covering the open bubbles. While such packages have provided efficient and effective packaging of individual dosages of medicament in pill form, such packages are not child proof or child resistant, and present a potential hazard to small children.

To render the typical blister package more child resistant, a number of packages have been devised which include additional features intended to render the package difficult for small children to open while at the same time being user friendly for adults including adults who have suffered some loss of manual dexterity.

U.S. Pat. No. 5,310,060 discloses a tamper evident, child resistant blister package in which a non-rupturable film layer is laminated to the outer surface of the rupturable foil lidding sheet, and an external cover sheet of paper or printable film is laminated to the non-rupturable film. A pattern of perforations is formed in and extends through the complete packages along the sides of the individual blisters to enable the user to press a tear tab from the package adjacent a blister. Scores and detents are provided in the package and the blister sheet, respectively, whereby as the pull tabs are lifted, the portion of the rupturable lidding sheet which covers a blister is separated from the pull tab in the area extending over the blister. Thereafter, the user can press on the blister to expel the pill through the rupturable sheet.

U.S. Pat. No. 5,758,774 discloses a blister package for pills in which a paperboard or other backing is provided over the rupturable lidding sheet, and individual scores are provided to enable peeling the backing sheet from the area of an individual blister to enable the pill to be expelled through the exposed rupturable sheet. Alternatively, the child resistant feature may be eliminated by removing the paper board backing from the area of the blister packages over the entire package.

Other child resistant blister packages may be found in U.S. Pat. Nos. 4,125,190; 4,506,789; 5,172,812; 5,323,907; 5,437,371; 5,529,188; 5,775,505; 5,785,180; 5,878,887; 5,927,500; and 5,915,559.

While the known child resistant blister packages have been effective, at least to some degree, in preventing access to the packaged medicament by young children, they have not been entirely satisfactory for a number of reasons. For example, some of the packages, while being child resistant initially, do not retain the desired degree of child resistance after a portion of the product has been dispensed. Also, product packages in some of the child resistant packages have not been as readily accessible to adults as desired, particularly those with loss of manual dexterity. Further, some of the known packages have been relatively expensive to manufacture and or assemble. Accordingly, it is a primarily object of the present invention to provide an improved, inexpensive, child resistant blister packages for medicaments.

Another object is to provide such a blister packages that retains its child resistant feature intact after each dosage use.

SUMMARY OF THE INVENTION

The above and other features and advantages are achieved in accordance with the present invention in which a sheet of polyvinyl chloride or other suitable material is thermoformed or die formed to create a series of blisters or drug dose cavities into each of which a pill is deposited. The blisters are then sealed by a thin sheet of aluminum foil or paper which may be ruptured to dispense the individual pill in the conventional manner. The blister forming sheet and the lidding sheet may be formed from any of the various FDA approved materials so that use of the invention will not require the time consuming and expensive stability studies frequently required for new or different packaging.

The blister package thus far described is conventional and, if desired, may be formed as a continuous strip which is cut into desired lengths containing the appropriate number of blister and corresponding pills to be packaged. One or more cut strips may be laminated onto a paperboard card containing the desired graphics and/or printed matter, with the card preferably being a solid bleach sulfate (SBS) board stock having a thickness of about 0.010 inches. The printed card is laminated onto the rupturable sheet of the blister package, serving to protect the rupturable sheet while adding conventional stability to the package and providing a readily printable surface. The card is provided with a plurality scored or perforated "punch-out" sections one overlying each blister, with the punch-outs preferably being larger than the blister to facilitate rupturing of the foil upon application of pressure to the blister to dispense a pill.

A transparent or translucent film overlay of suitable material such as polyester is then applied over the external surface of the paperboard backing card, using a "low peel" adhesive to continuously bond the overlay to the paper board. The overlay is scored to provide a separate frangible section overlaying each punch-out so that, when a section is peeled from the area of a blister, it will tear along the score lines and leave all remaining punch outs covered. The strength of the polyester positively prevents the pills from being pushed through the foil and the scored or perforated punch-outs in the cardboard backing, thereby preventing a child from being able to access the drug by pushing on the blister. The low peel strength adhesive used to laminate the overlay to the paperboard makes the overlay easily removable by adults or seniors. At the same time, the adhesive has sufficient strength so that removal of the overlay removes the paperboard punch-out sections. Thereafter, the pill can be easily dispensed by pushing on the blister to rupture the aluminum foil lidding sheet in the conventional push-through method.

BRIEF DESCRIPTION OF THE DRAWINGS

Other features and advantages of the invention will be apparent from the detailed description contain herein below, taken in conjunction with the drawings, in which.

DESCRIPTION OF THE PREFERRED EMBODIMENTS

Figure 2:
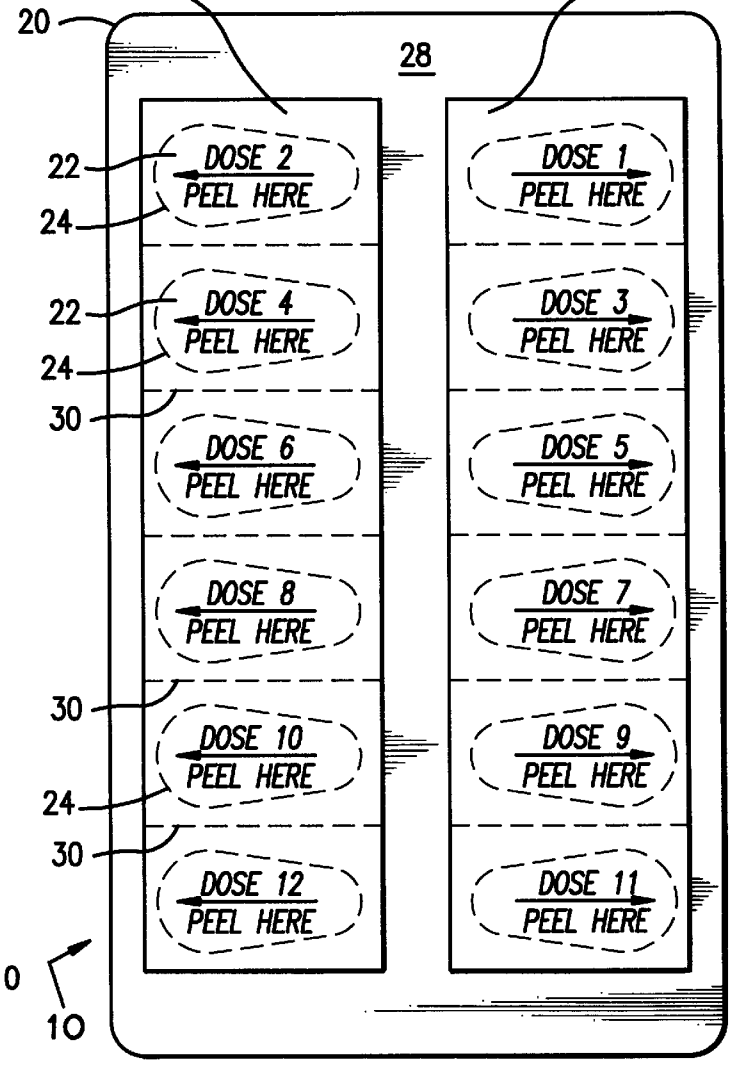
FIG. 2 is a bottom plan view of the package shown in FIG. 1.

A child resistant blister card package for a solid dosage form of drug is indicated generally by the reference numeral 10. Package 10 comprises a top, blister containing laminate 12 having integrally formed there in a plurality of cavity-forming blisters 14 projecting upwardly from its top, or exposed surface for containing a single dosage, or pill 16, of the drug or product to be package. Laminate 12 preferably formed from a PVC based film, but may be formed from any of the variety of the blister films or products which have been approved by the FDA, including films or aluminum foil which are die formed or otherwise shaped to provide the blisters.

After the pills 16 are deposited one in each cavity, a lidding sheet or foil 18 has one surface laminated onto the lower surface of blister laminate foil, with the lidding foil extending over and closing the open ends of the respective blisters 14. A suitable heat or pressure activated adhesive, not shown in the drawing, is employed and the conventional manner bonding the lidding laminate to the blister laminate. Again, the lidding sheet may be any conventional lidding material such as a thin aluminum foil or paper material approved by the FDA.

Thus far described, the package is conventional. In accordance with the present invention, a card backing 20 is laminated onto the other surface of lidding foil 18, again employing a suitable adhesive, not shown, such as a pressure or temperature setting adhesive.

As seen in FIG. 2, card 20 is formed with a series of punch-out sections 22 each defined by a die cut or perforated line 24. Punch-outs 22 are located on card 20 so that, when the card is laminated into the package, a separate punch-out 22 extends over, or beneath, each of the blisters 14. The score lines 24 sufficiently weakens the card 20 so that the punch-outs are easily torn from the card when lifted from one end, or edge, of the respective punch-outs.

Figure 1:
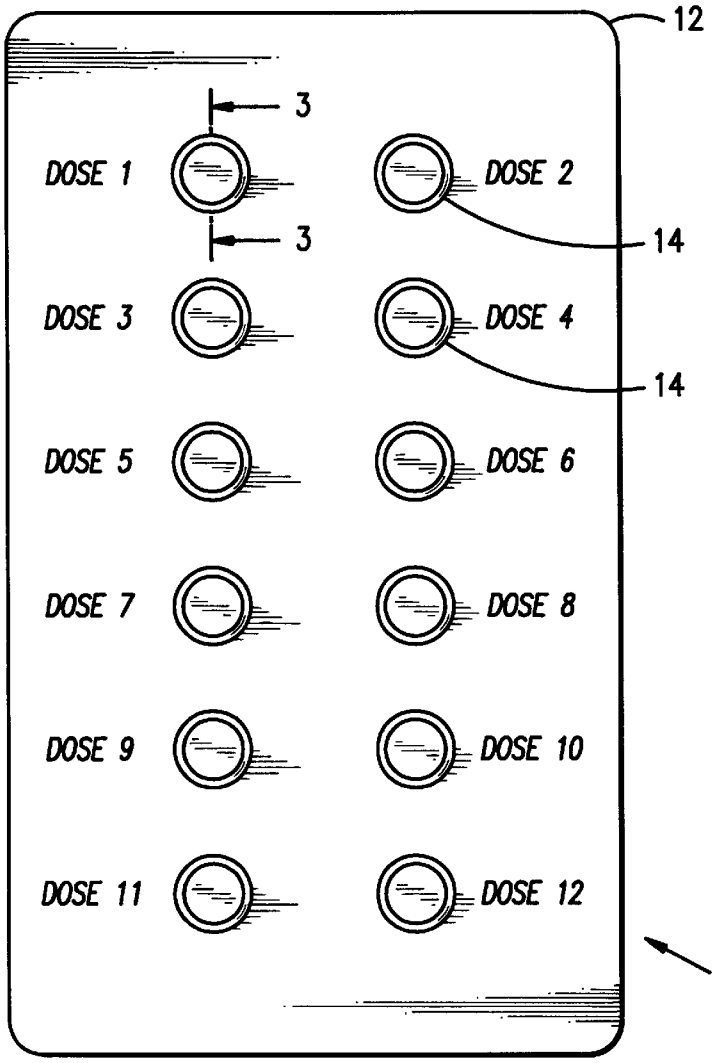
FIG. 1 is a top plan view of a blister medicament package embodying the invention.
Figure 3:
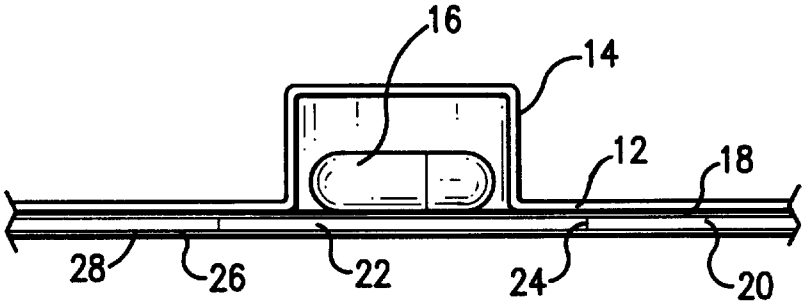
FIG. 3 is an enlarged fragmentary section view taken along line 3—3 of FIG. 1.

As shown in FIGS. 1 and 2, the blisters 14 are preferably arranged in a straight line pattern, or in a parallel straight line rows in the blister laminate 12. In practice, the laminate 12 may be initially formed as an elongated, substantially continuous strip, having a single or multiple rows of blisters formed therein. A pill may be deposited into each blister and the lidding laminate applied in this continuous strip form, with the strip containing the pills packaged therein then being cut into individual package size strips or segments which are then laminated onto the surface of the supporting card 20. Card 20 is preferably formed from a printable card stock such as SBS board stock having a suitable thickness to provide the desired flexibility and/or strength characteristics of the package.

A film 26 of relatively high strength, flexible synthetic polymeric material such as a polyester film is then laminated onto the exposed back surface 28 of card 20. The film 26 is formed with a pattern of perforations or score lines defining weakened lines 30 separating the portion of the film 26 overlying each punch-out 22 from the portion overlying each other punch-out. When the package 10 includes multiple rows of blisters 14, the film 26 may be applied in separate strips, or bands, one overlying each row of punch-outs and blisters as shown in FIG. 2. Alternatively, of course, a perforated line 30 could be formed in the film 26 at a location separating the respective rows of punch-outs as well as separating the adjacent punch-outs in each row. When only a single pill is to be packaged, obviously the perforation lines in the film 26 would not be required.

Preferably a low peel strength adhesive is employed to bond the film 26 to the surface 28 so that the film can be readily peeled from surface 28 by an adult to remove the segment of film 26 overlying the respective punch-outs. At the same time, the weakened perforated lines 24 around their respective punch-outs preferably are such as to cause the punch-out to be lifted with the film to expose the lidding foil 18 beneath the punch-out and overlying the individual blister. Alternatively, the film 26 may be peeled off, then the punch-outs removed. Continuous lifting of the segment of film 26 causes the film to tear off along the adjacent line 30 so that the child resistant feature is retained intact for all other doses. After removing the segment of the film 26 and the underlying punch-out 22, the packaged pill can be dispensed by applying pressure the blister to rupture the underlying lidding foil in the conventional manner.

By using a relatively high strength, thin flexible film 26 overlying all the punch-outs in the package, it becomes virtually impossible to access the packaged pills by applying pressure to the blisters, thereby rendering the package highly child resistant.

Preferably film 26 is colored to contrast with the surface of card 20 to make it easier for persons with poor vision to see the edge of the strip to thereby facilitate removal.

Figure 4:
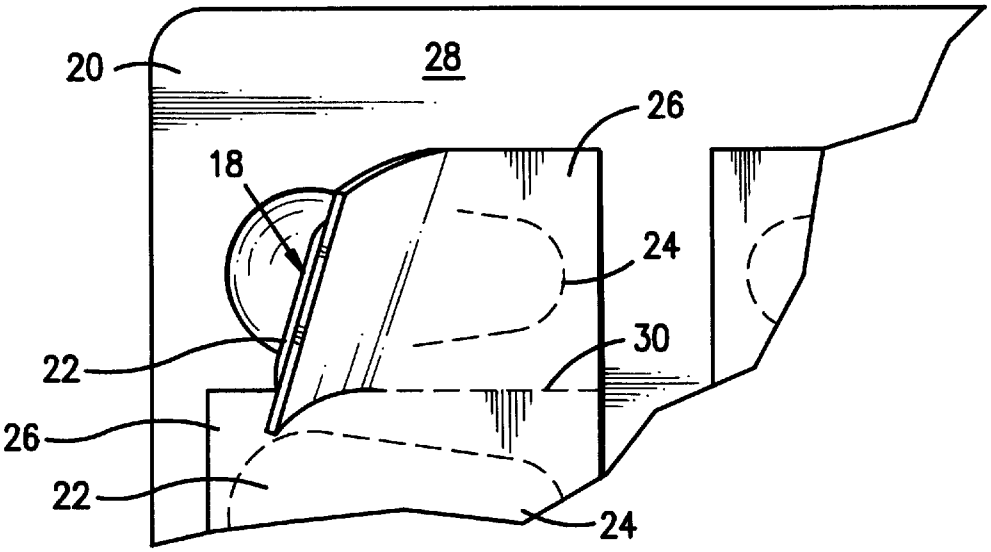
FIG. 4 is an enlarged frangementary isometric view of a portion of the package illustrating one step in opening of a single blister compartment of the package.

As seen in FIG. 4, to dispense a pill from the package, the segment of film 26 underlying one of the blisters is removed by initially lifting the edge of the film adjacent to one end of the punch-out 22. This can be done by inserting a fingernail or a thin instrument under the edge of the film 26 and lifting to peel the film from the card and simultaneously tear the punch-out 22 from the card. In bonding the backing card 20 to the lidding foil 18, a resistant pad may be used to press the two elements together, with the pad having reliefs or cut-outs therein in the area of the punch-outs 22 so that no bond is achieved in this area. This permits the punch-outs to be lifted with the foil 26, leaving the foil 18 exposed through the opening left by removal of the punch-out. Thereafter, the pill is dispensed by pressing on the blister to rupture the lidding foil in the conventional manner. As the film and punch-out are lifted, the film readily tears along the adjacent perforated line 30, leaving the child resistant feature intact for the remainder of the pill packages.

In an alternative embodiment a second or cover layer of card stock may be laminated to the top surface blister laminated 12. In this case, the top card has an opening formed therein to fit around and receive the respective blisters. The cover is bonded by a suitable pressure or heat sensitive adhesive to the surface of the blister laminate 12. This cover is of a printable material to facilitate marking the package or doses in the manner illustrated, for example in FIG. 1. This embodiment is particularly useful in the area of clinical trials where special instructions may be required to be followed by the patient.

In another alternate embodiment of the invention, the card laminate 20 may be extended from one lateral edge thereof and be double scored to enable folding of the extended portion back over the top of the exposed blisters much in the manner of a notebook cover, to act as a protection for the package. Such package arrangements, including such folded covers on both sides of the package, are known in the art.

While preferred embodiments of the invention have been disclosed and described in detail, it is to be understood that the invention is not so limited, but rather it is intended to include all embodiments which would be apparent to one skilled in the art and which come within the spirit and scope of the invention.

What is claimed is:

1. A child resistant package for medicaments in pill form comprising, a blister sheet having a pill receiving blister cavity integrally formed therein and projecting from one side thereof, a rupturable lidding foil laminated onto the other surface of said blister sheet, said lidding foil extending over and sealingly closing said blister cavity, a backing card having one surface overlying and adhesively bonded to said lidding foil, said backing card having a punch-out section formed therein overlying said blister cavity, said punch-out section being defined by a weakened score line in the backing card, and a thin film of high strength, flexible material adhesively bonded to the other surface of said backing card, said thin film extending over said punch-out section and at least a portion of the backing card surrounding said punch-out, section said thin film being bonded to said card by a low peel strength adhesive whereby the thin film can be manually pulled off the package by an adult but can not readily be pulled off by a child, said low peel strength adhesive providing a bond with said punch-out section to remove the punch-out section upon peeling the thin film from the card.

2. The child resistant package defined in claim 1 wherein said blister sheet has a plurality of blister cavities integrally formed therein and wherein said lidding foil extends over and sealingly closes each said blister cavity, said backing card having a plurality of a punch-out sections formed therein one overlying each said blister cavity and said thin film extending over each said punch-out section and an area of the card surrounding each punch-out section, said thin film having a pattern of weakening score lines formed therein separating the area of the thin film overlying each said punch-out section from the area overlying each of the other said punch-out sections, whereby when the thin film is peeled from the portion of the card overlying one punch-out section, the section of peeled thin film will be severed from the remainder of the thin film along at least one weakening score score line.

3. The child resistant package defined in claim 2 wherein said blister sheet is formed from a polyvinyl chloride sheet.

4. The child resistant package defined in claim 2 wherein said thin film is a polyester film.

5. The child resistant package defined in claim 4 wherein said polyester film and said backing card are of contrasting colors.

6. The child resistant package defined in claim 2 wherein said punch-out sections each have a size larger than one respective said blister cavity.

7. The child resistant package defined in claim 2 wherein said blister sheet comprises an elongated blister strip having a plurality of blister cavities formed in a row along the length of the strip, and wherein said thin film is an elongated strip having weakening score lines extending transversely thereof across its full width, said thin film being laminated to said backing card with one of said weakening score lines positioned in substantially equally spaced relation between each adjacent pair of blister cavities.

8. The child resistant package defined in claim 7 further comprises a plurality of elongated blister strips mounted in parallel spaced relation to one another on said backing card, and a plurality of elongated strips of thin film mounted in overlying relation to each said elongated blister strip.

* * * * *